US008656813B1

(12) United States Patent
Aldredge et al.

(10) Patent No.: US 8,656,813 B1
(45) Date of Patent: Feb. 25, 2014

(54) LOCKING PLIERS

(71) Applicants: Robert L. Aldredge, Englewood, OH (US); Michael Bogart, Troy, OH (US); Daniel J Schaefer, Huber Heights, OH (US); David P. Engvall, Stanley, NC (US)

(72) Inventors: Robert L. Aldredge, Englewood, OH (US); Michael Bogart, Troy, OH (US); Daniel J Schaefer, Huber Heights, OH (US); David P. Engvall, Stanley, NC (US)

( * ) Notice: Subject to any disclaimer, the term of this patent is extended or adjusted under 35 U.S.C. 154(b) by 0 days.

(21) Appl. No.: 14/043,238

(22) Filed: Oct. 1, 2013

(51) Int. Cl.
*B25B 7/12* (2006.01)
*B25B 5/12* (2006.01)

(52) U.S. Cl.
CPC . *B25B 7/12* (2013.01); *B25B 7/123* (2013.01); *B25B 5/12* (2013.01)
USPC ..... 81/427.5; 81/421; 81/368

(58) Field of Classification Search
CPC ..... B25B 7/12; B25B 7/123; B25B 7/10; B25B 7/08; B25B 7/06; B25B 7/04; B25B 7/00; B25B 5/125; B25B 5/12; B25B 5/04; B25B 5/06
USPC ..... 81/367–385, 342, 346, 348, 405, 416
See application file for complete search history.

(56) References Cited

U.S. PATENT DOCUMENTS

| | | | | |
|---|---|---|---|---|
| 2,496,309 | A * | 2/1950 | Pugh | 81/380 |
| 2,500,590 | A * | 3/1950 | Ward et al. | 81/377 |
| 2,777,347 | A * | 1/1957 | Sendoykas | 81/379 |
| 3,195,382 | A * | 7/1965 | Wilhelm et al. | 81/368 |
| 5,056,385 | A | 10/1991 | Petersen | |
| 5,435,214 | A * | 7/1995 | Sisson | 81/376 |
| 6,095,019 | A | 8/2000 | Warheit et al. | |
| 7,762,162 | B2 | 7/2010 | Phillips, Sr. et al. | |

* cited by examiner

*Primary Examiner* — Hadi Shakeri
(74) *Attorney, Agent, or Firm* — Donald J. Ersler

(57) ABSTRACT

A locking pliers preferably includes a fixed jaw, a movable jaw, a fixed handle, an adjusting screw, a biasing spring, a toggle link, a power triangle link, at least one tie link and a movable handle. The fixed jaw, the movable jaw, the fixed handle, the adjusting screw and the biasing spring are preferably taken from an Irwin item no. 502L3 vise grips, but other parts may also be used. A second embodiment of the locking pliers preferably includes a fixed jaw, a movable jaw, a fixed handle, an adjusting screw, a biasing spring, a toggle link, two power links, at least one tie link, a release link and a movable handle. The fixed jaw, the movable jaw, the fixed handle, the adjusting screw and the biasing spring are preferably taken from an Irwin item no. 502L3 vise grips.

19 Claims, 8 Drawing Sheets

LOCKING PLIERS

BACKGROUND OF THE INVENTION

1. Field of the Invention

The present invention relates generally to hand tools and more specifically to a locking pliers, which includes a reduced distance between the fixed handle and the movable when the locking pliers is an open position.

2. Discussion of the Prior Art

U.S. Pat. No. 5,056,385 to Petersen discloses a compound toggle link. U.S. Pat. No. 6,095,019 to Warheit et al. discloses a locking plier tool. U.S. Pat. No. 7,762,162 to Phillips, Sr. et al. discloses a locking pliers with cam.

Accordingly, there is a clearly felt need in the art for a locking pliers, which includes a reduced distance between the fixed handle and the movable when the locking pliers is an open position, relative to the prior art.

SUMMARY OF THE INVENTION

The present invention provides a locking pliers, which includes a reduced distance between the fixed handle and the movable when the locking pliers is an open position. The locking pliers preferably includes a fixed jaw, a movable jaw, a fixed handle, an adjusting screw, a biasing spring, a toggle link, a power triangle link, at least one tie link and a movable handle. The fixed jaw, the movable jaw, the fixed handle, the adjusting screw and the biasing spring are preferably taken from an Irwin item no. 502L3 vise grips, but other parts may also be used. U.S. Pat. No. 5,056,385 is hereby incorporated into this patent application by reference in its entirety. The fixed jaw is retained in one end of the fixed handle and the adjusting screw is threadably retained in an opposing end of the fixed handle. The movable jaw is pivotally retained in the one end of the fixed handle. One end of the biasing spring is attached to the movable jaw and the other end is attached to the fixed handle.

The toggle link includes a first end and a second end. A pivot lip extends from the first end of the toggle link. The movable handle includes a first end and a second end. The power triangle link preferably includes a U-shaped cross-section and has a substantially triangle shape. The power triangle link includes a first corner, a second corner and a third corner. A jaw pivot hole is formed through the first corner; a handle pivot hole is formed through the second corner; and a toggle pivot hole is formed through the third corner. The second end of the toggle link is pivotally engaged with the toggle pivot hole with a toggle pin.

Substantially a first end of the movable handle is pivotally engaged with the handle pivot hole with a handle pin. One end of the at least one tie link is pivotally engaged with the toggle link at substantially the second end thereof and the other end of the at least one tie link is pivotally engaged with the movable handle at substantially a middle thereof.

A second embodiment of the locking pliers preferably includes a fixed jaw, a movable jaw, a fixed handle, an adjusting screw, a biasing spring, a toggle link, two power links, at least one tie link, a release link and a movable handle. The fixed jaw, the movable jaw, the fixed handle, the adjusting screw and the biasing spring are preferably taken from an Irwin item no. 502L3 vise grips, but other parts may also be used. The fixed jaw is retained in one end of the fixed handle and the adjusting screw is threadably retained in an opposing end of the fixed handle. The movable jaw is pivotally retained in the one end of the fixed handle. One end of the biasing spring is attached to the movable jaw and the other end is attached to the fixed handle.

The toggle link includes a first end and a second end. A pivot lip extends from the first end of the toggle link and a pin cavity is formed in the second end of the toggle link. The movable handle includes a first end and a second end. First and second power links include a first end and a second end. A jaw pivot hole is formed through the first end of the first and second power links; a handle pivot hole is formed through the second end thereof; and a release pivot hole is formed between the first and second ends thereof.

The movable jaw is pivotally engaged with the jaw pivot hole of the two power links utilizing a jaw pin. Substantially a first end of the movable handle is pivotally engaged with the handle pivot hole of the two power links with a handle pin. The release link includes a first plate, a second plate and a connection member. The first plate extends from a first end of the connection member and the second plate extends from a second end of the connection member. A release hole is formed through a first end of the first and second plates and a toggle hole is formed through a second end of the first and second plates.

One end of the at least one tie link is pivotally engaged with the toggle link at substantially the second end thereof and the other end of the tie link is pivotally engaged with the movable handle at substantially a middle thereof. Substantially the second end of the toggle link is pivotally engaged with the toggle pivot hole in the release link utilizing a toggle pin. The release pivot hole of the release link is pivotally engaged with release pivot hole of the two power links with a power pin.

Accordingly, it is an object of the present invention to provide a locking pliers, which includes a reduced distance between the fixed handle and the movable when the locking pliers is an open position, relative to the prior art.

These and additional objects, advantages, features and benefits of the present invention will become apparent from the following specification.

DETAILED DESCRIPTION OF THE PREFERRED EMBODIMENTS

Figure 1:
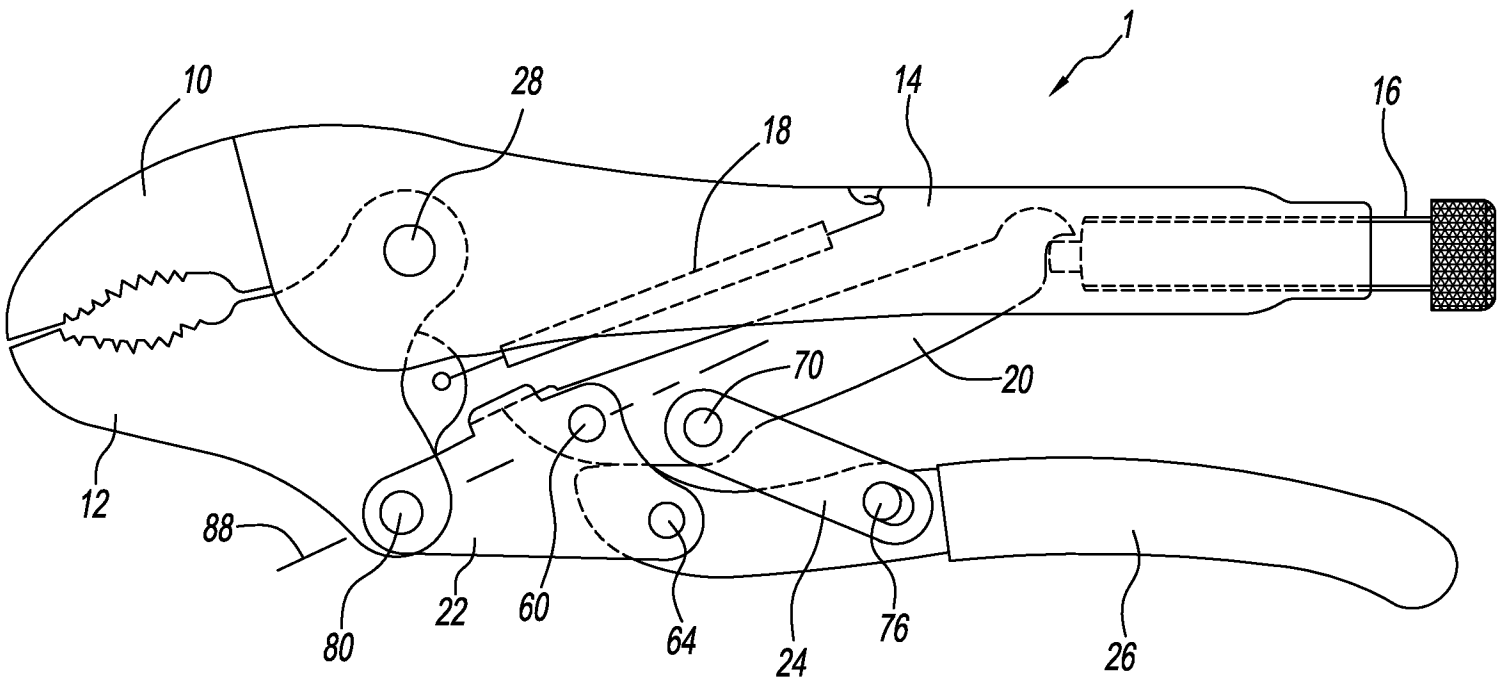
FIG. 1 is a side view of a locking pliers in a closed orientation in accordance with the present invention.
Figure 2:
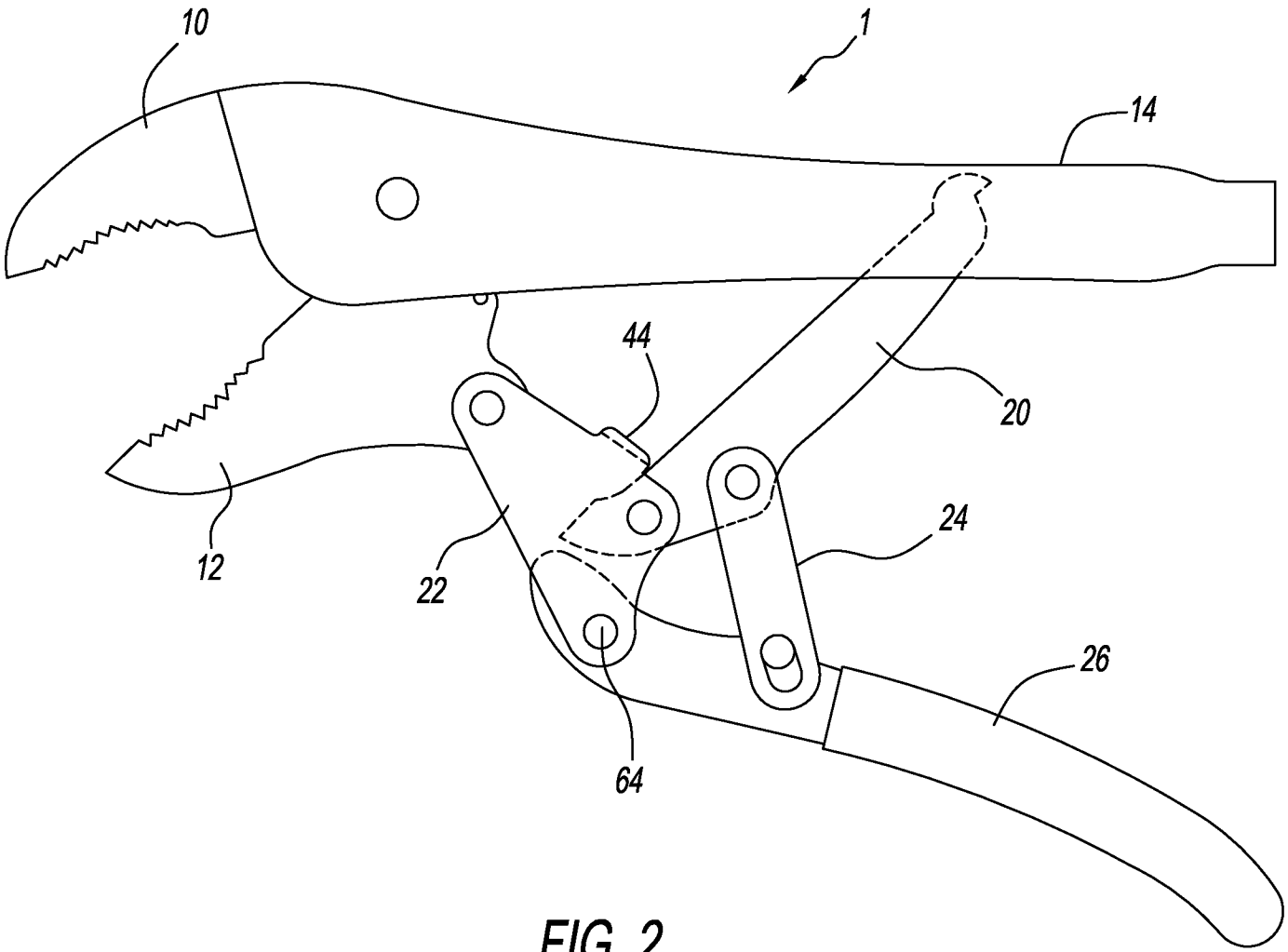
FIG. 2 is a side view of a locking pliers in an open orientation in accordance with the present invention.
Figure 3:
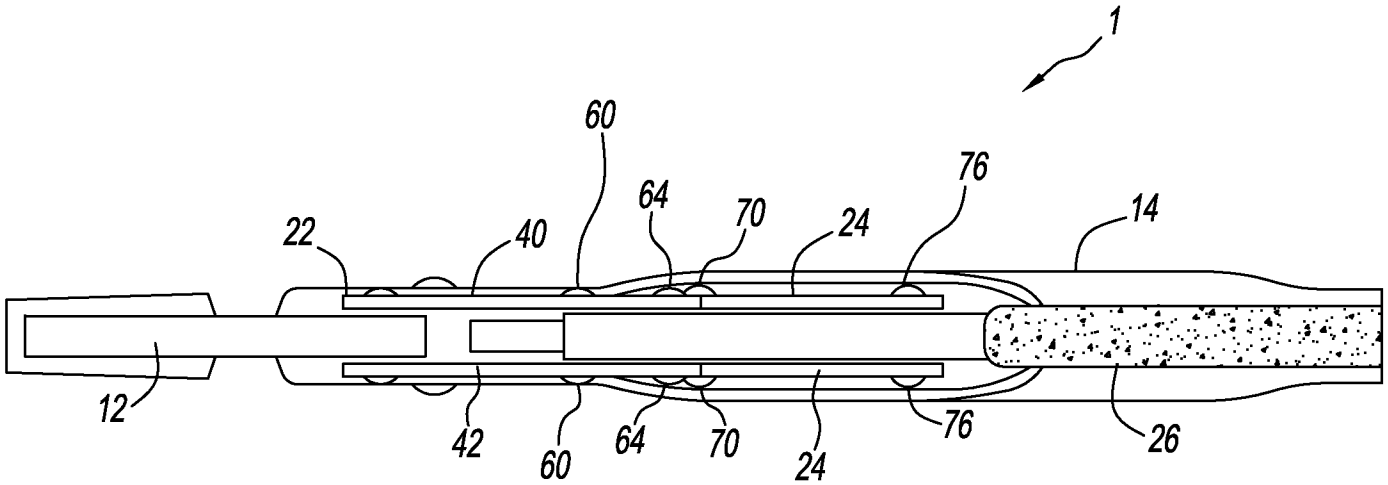
FIG. 3 is a bottom view of a locking pliers in an open orientation in accordance with the present invention.
Figure 4:
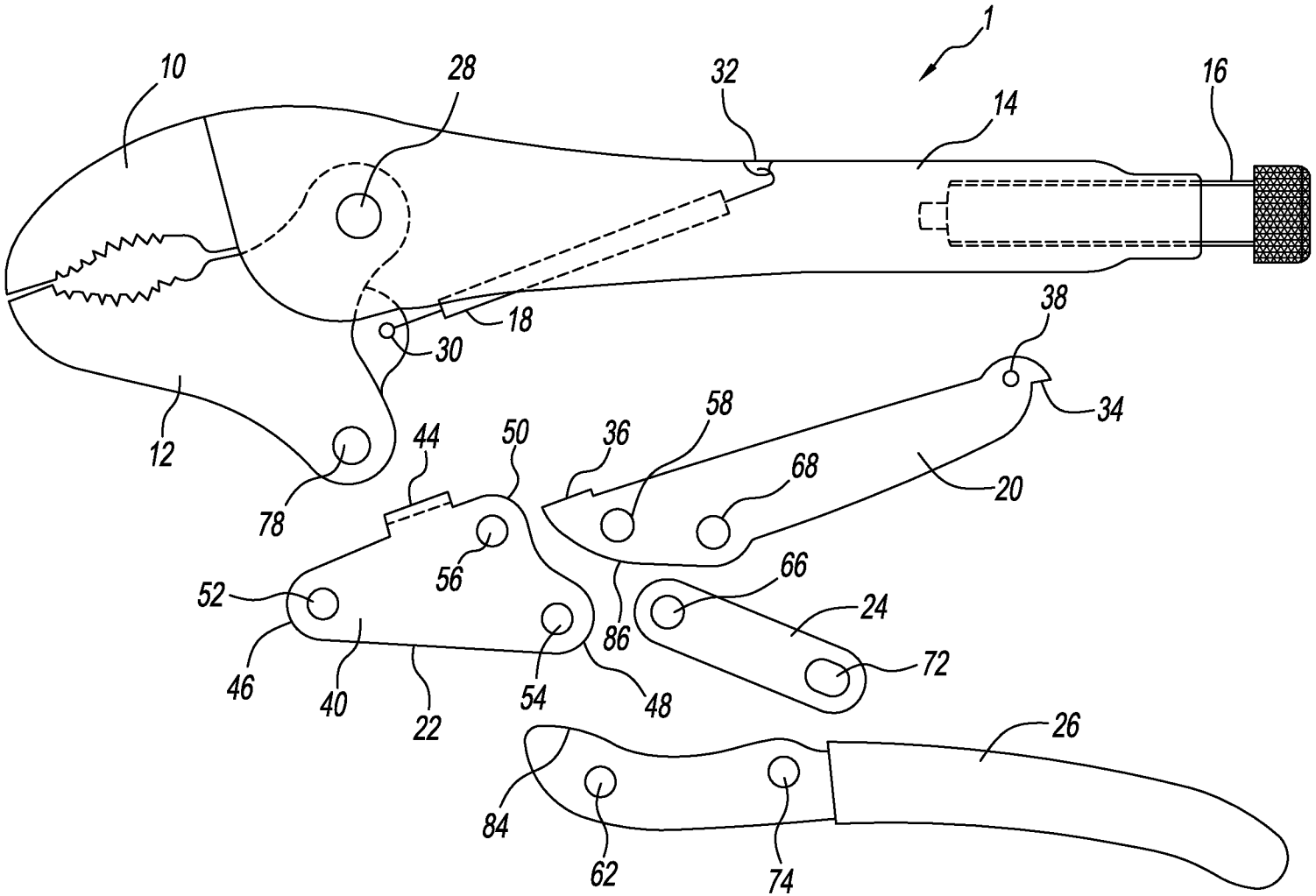
FIG. 4 is an exploded side view of a locking pliers in a open orientation in accordance with the present invention.
Figure 5:
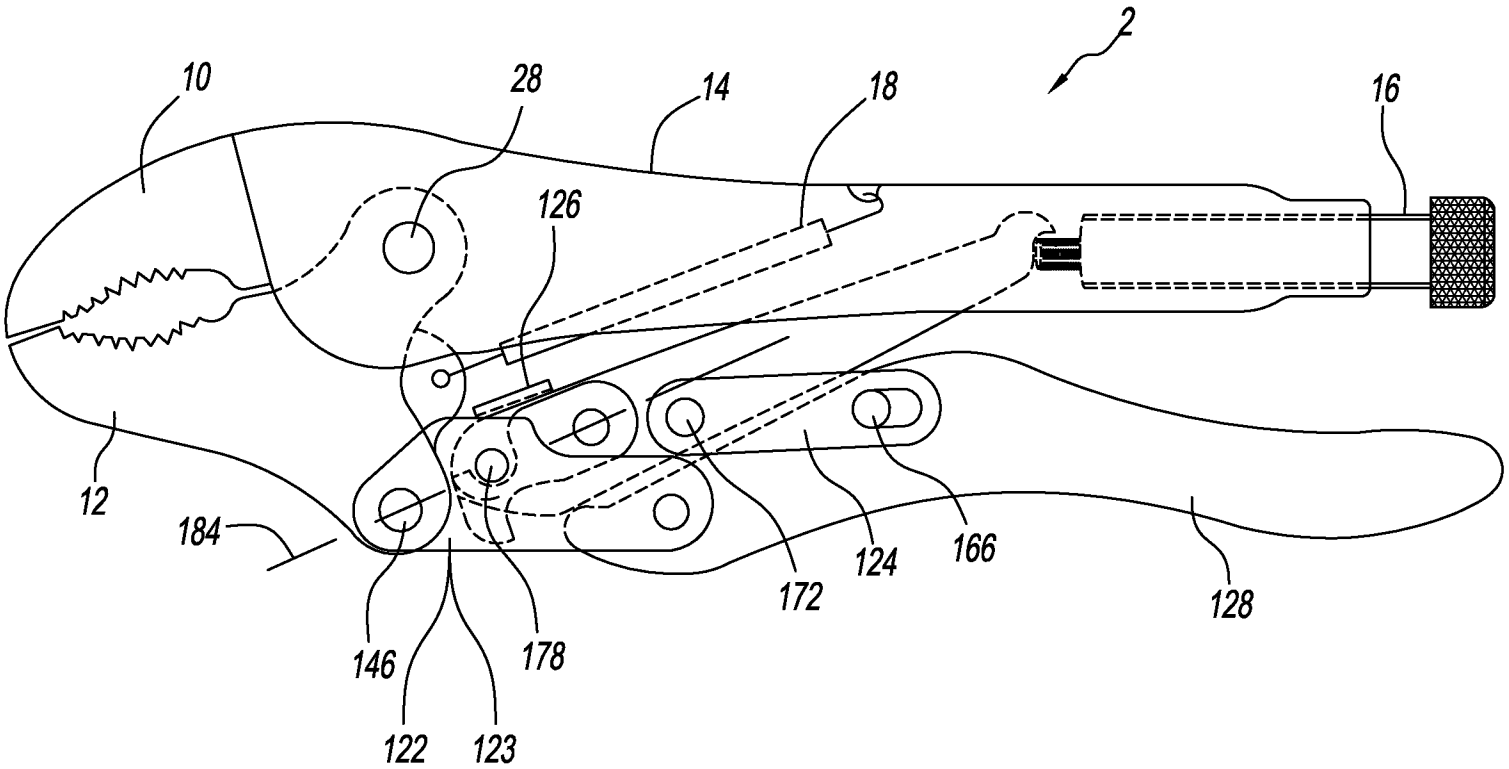
FIG. 5 is a side view of a second embodiment of a locking pliers in a closed orientation in accordance with the present invention.
Figure 6:
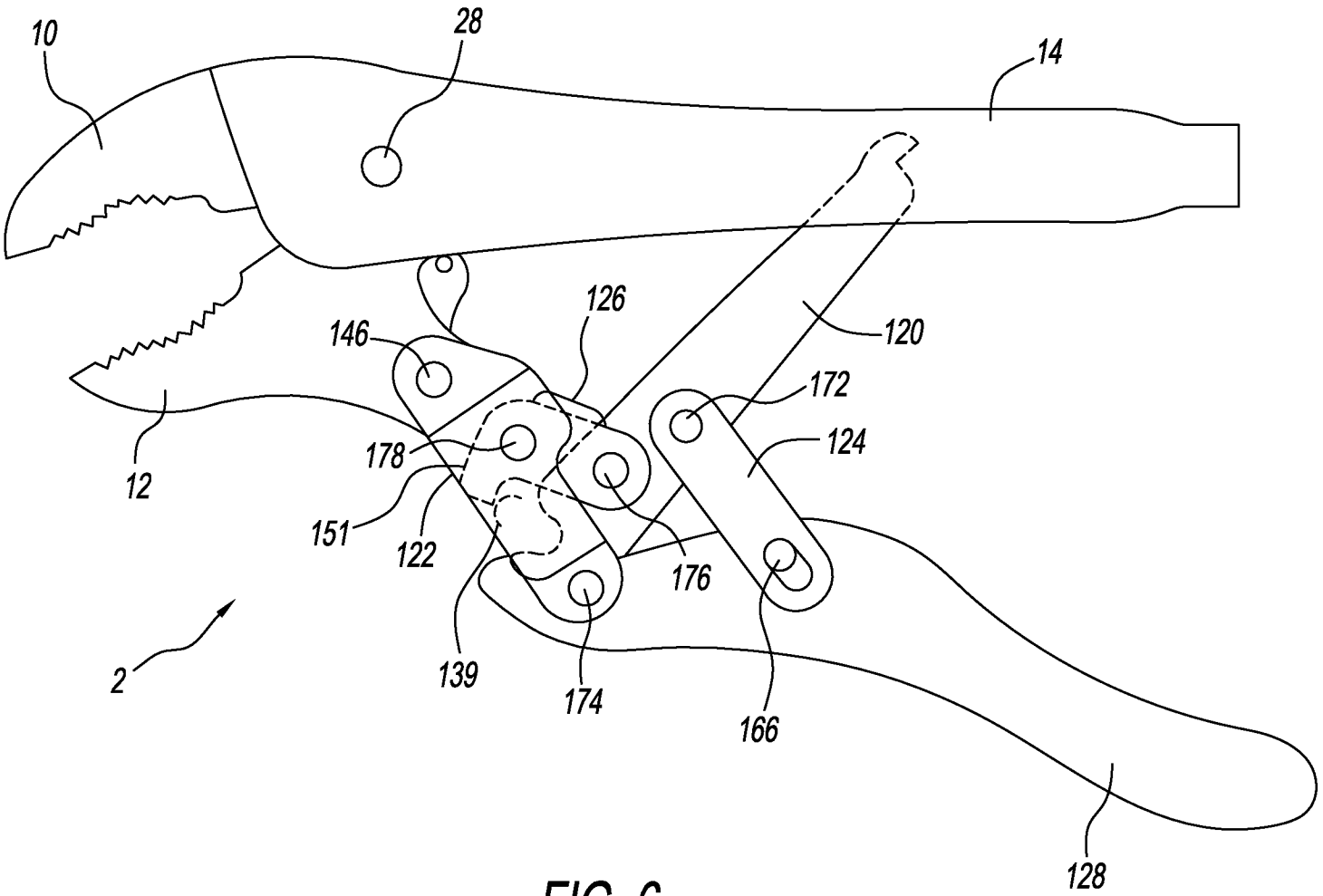
FIG. 6 is a side view of a second embodiment of a locking pliers in an open orientation in accordance with the present invention.
Figure 7:
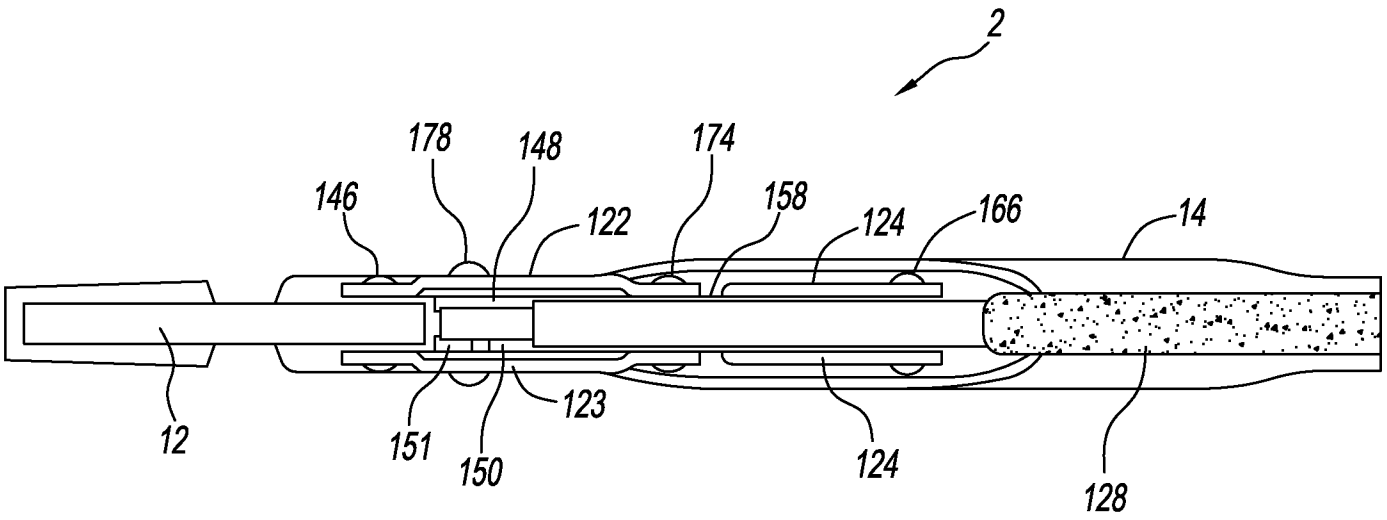
FIG. 7 is a bottom view of a second embodiment of a locking pliers in an open orientation in accordance with the present invention.
Figures 8, 8A:
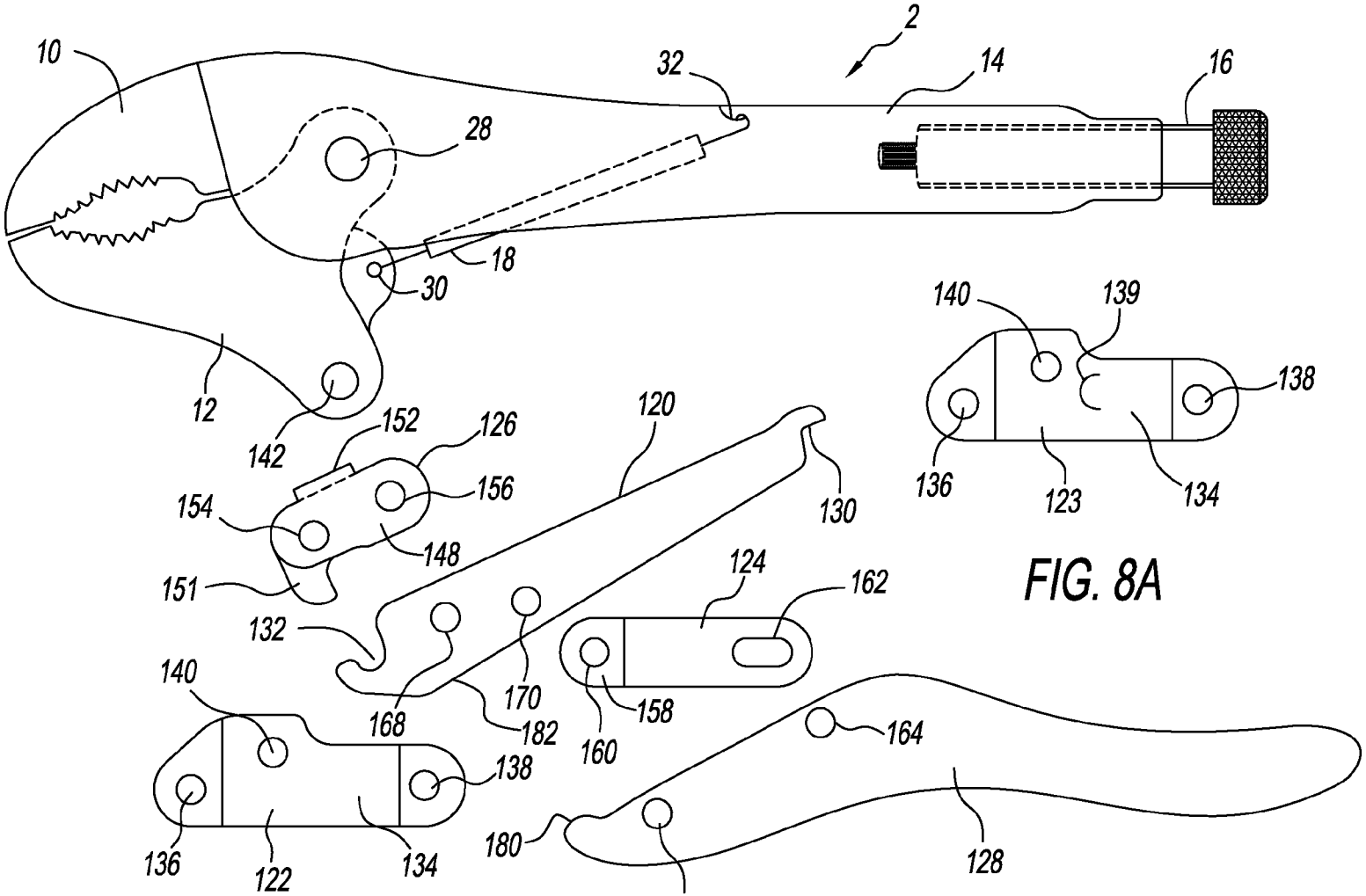
FIG. 8 is an exploded side view of a second embodiment of a locking pliers in an open orientation in accordance with the present invention.
FIG. 8*a* is an inside side view of a second power link of a second embodiment of a locking pliers in accordance with the present invention.

With reference now to the drawings, and particularly to FIG. 1, there is shown a side view of a locking pliers 1. With reference to FIGS. 2-4, the locking pliers 1 preferably includes a fixed jaw 10, a movable jaw 12, a fixed handle 14, an adjusting screw 16, a biasing spring 18, a toggle link 20, a power triangle link 22, at least one tie link 24 and a movable handle 26. The fixed jaw 10, the movable jaw 12, the fixed handle 14, the adjusting screw 16 and the biasing spring 18 are preferably taken from an Irwin item no. 502L3 vise grips, but other parts may also be used. The fixed jaw 10 is preferably retained in one end of the fixed handle 14 with welding or the like. The adjusting screw 16 is threadably retained in an opposing end of the fixed handle 14. The movable jaw 12 is pivotally retained in the one end of the fixed handle 14 with a rivet 28 or the like. One end of the biasing spring 18 is retained in a spring hole 30 formed through the movable jaw 12 and the other end is attached to a retention opening 32 formed in substantially a middle of the fixed handle 14.

The toggle link 20 includes a first end and a second end. A pivot lip 34 extends from the first end of the toggle link 20 and a stop surface 36 is formed on the second end thereof. A retention pin 38 is preferably pressed through the first end of the toggle link 20 to retain the second end of the toggle link 20 in the fixed handle 14. The movable handle 26 includes a first end and a second end. The power triangle link 22 includes a first triangle plate 40, a second triangle plate 42 and a connection plate 44. The first triangle plate 40 extends from one end of the connection plate 44 and the second triangle plate 42 extends from the other end of the connection plate 44. The stop surface 36 of the toggle link 20 contacts an underside of the connection plate 44, when the locking pliers 1 is in a closed position. The first and second triangle plates 40, 42 preferably have a substantial triangle shape. The first and second triangle plates 40, 42 include a first corner 46, a second corner 48 and a third corner 50. A jaw pivot hole 52 is formed through the first corner 46; a handle pivot hole 54 is formed through the second corner 48; and a toggle pivot hole 56 is formed through the third corner 50.

A toggle pivot hole 58 is formed through the second end of the toggle link 20 to receive a toggle pin 60 to pivotally engage the power triangle link 22 with the toggle link 20. A handle pivot hole 62 is formed through substantially a first end of the movable handle 26. A handle pin 64 is retained in the handle pivot hole 62 and the handle pivot hole 54 to pivotally retain the movable handle 26 relative to the power triangle link 22. A toggle hole 66 is formed through one end of the at least one tie link 24. A link pivot hole 68 is formed through the toggle link 20. A link pin 70 is retained in the toggle hole 66 and the link pivot hole 68 to pivotally retain the toggle link 20 relative to the at least one tie link 24. A link slot 72 is formed through the other end of the at least one tie link 24.

A tie hole 74 is formed through substantially a middle of the movable handle 26. A tie pin 76 is slidably retained in the link slot 72 and the tie hole 74 to pivotally and slidably retain the at least one tie link 24 to the movable handle 26. A jaw hole 78 is formed through the movable jaw 12. A jaw pin 80 is retained in the jaw hole 78 and the jaw pivot holes 52 to pivotally engage the power triangle link 22 with the movable jaw 12.

A cam surface 84 is formed on the first end of the movable handle 26. A contact surface 86 is formed on the second end of the toggle link 20. When the locking pliers 1 is closed, the toggle link 20 goes over a powerline 88; and the stop surface 36 contacts an underside of the connection plate 44. The locking pliers 1 is opened by pulling the movable handle 26 away from the fixed handle 14; the cam surface 84 has contact with the contact surface 86, causing the power triangle link 22 to rotate clockwise; the power triangle link 22 rotation causes the toggle link 20 to pass through the powerline 88. Continued travel of the movable handle 26 causes the tie pin 76 to bottom out in the link slot 72 and the power link triangle 22 to open the movable jaw 12.

Additionally, a kit may be sold, which contains the toggle link 20, the power triangle link 22, the at least one tie link 24, and the movable handle 26. The kit would be used to retrofit an existing Irwin item no. 502L3 vise grips into the locking pliers 1.

With reference to FIGS. 5-8, a second embodiment of the locking pliers 2 preferably includes the fixed jaw 10, the movable jaw 12, the fixed handle 14, the adjusting screw 16, the biasing spring 18, a toggle link 120, two power links 122, 123, at least one tie link 124, a release link 126 and a movable handle 128. The fixed jaw 10, the movable jaw 12, the fixed handle 14, the adjusting screw 16 and the biasing spring 18 are preferably taken from an Irwin item no. 502L3 vise grips, but other parts may also be used. The fixed jaw 10 is preferably retained in one end of the fixed handle 14 with welding or the like. The adjusting screw 16 is threadably retained in an opposing end of the fixed handle 14. The movable jaw 12 is pivotally retained in the one end of the fixed handle 14 with a rivet 28 or the like. One end of the biasing spring 18 is retained in a spring hole 30 formed through the movable jaw 12 and the other end is attached to a retention opening 32 formed in substantially a middle of the fixed handle 14.

The toggle link 120 includes a first end and a second end. A pivot lip 130 extends from the first end of the toggle link 120 and a pin cavity 132 is formed on the second end of the toggle link 120. The movable handle 128 includes a first end and a second end. First and second power links 122, 123 include a first end and a second end. Each power link 122, 123 includes a middle offset portion 134, which provides clearance for a width of the release link 126. A jaw pivot hole 136 is formed through the first end of the power links 122, 123; a handle pivot hole 138 is formed through the second end thereof; and a release pivot hole 140 is formed between the first and second ends thereof.

A jaw hole 142 is formed through the movable jaw 12. A jaw pin 146 is retained in the jaw hole 142 and the jaw pivot holes 136 to pivotally engage the first and second power links 122, 123 with the movable jaw 12. A link hole 144 is formed through substantially the first end of the movable handle 128. The release link 126 includes a first plate 148, a second plate 150 and a connection member 152. The first plate 148 extends from a first end of the connection member 152 and the second plate 150 extends from a second end of the connection member 152. A release hole 154 is formed through a first end of the first and second plates 148, 150 and a toggle hole 156 is formed through a second end of the first and second plates 148, 150. A retention projection 151 extends from the first end of the second plate 150. A projection stop 139 is formed between the first and second ends of the second power link 123. The projection stop 139 engages the retention projection 151.

A first end 158 of each tie link 124 is offset from a length thereof. A toggle hole 160 is formed through the first end 158. A link slot 162 is formed through a second end of each tie link 124. A tie hole 164 is formed through the movable handle 128 between the first and second ends thereof. A tie pin 166 is retained in the tie hole 164 and slidably retained in the link slot 162 to pivotally and slidably retain the at least one tie link 124 relative to the movable handle 128. A toggle pivot hole 168 is formed through substantially the second end of the toggle link 120. A link pivot hole 170 is formed through the toggle link 120, between the toggle pivot hole 168 and the first end of the toggle link 120. A link pin 172 is retained in the toggle hole 160 and the link pivot hole 170 to pivotally retain the toggle link 120 relative to the at least one tie link 124.

A handle pin 174 is retained in the link hole 144 and the handle pivot holes 138 to pivotally retain the movable handle 128 relative to the power links 122, 123. A toggle pin 176 is retained in the toggle pivot hole 168 and the toggle hole 156 to pivotally retain the toggle link 120 relative to the release link 126. A power pin 178 is retained in the release pivot holes 140 and the release holes 154 to pivotally retain the power links 122, 123 relative to the release link 126. The pin cavity 132 is sized to receive the power pin 178.

A cam surface 180 is formed on the first end of the movable handle 128. A contact surface 182 is formed on the second end of the toggle link 120. When the locking pliers 2 is closed, the toggle link 120 goes over a powerline 184; and the pin cavity 132 acts as a stop for the power pin 178. The locking pliers 2 is opened by pulling the movable handle 128 away from the fixed handle 14; the cam surface 180 has contact with the contact surface 182, causing the two power links 122, 123 to rotate clockwise; the two power links 122, 123 rotation causes the toggle link 120 to pass through the powerline 184. Continued travel of the movable handle 128 causes the tie pin 166 to bottom out in the link slot 162 and the two power links 122, 123 to open the movable jaw 12.

Additionally, a kit may be sold, which contains the toggle link 120, the two power links 122, 123, the at least one tie link 124, the release link 126 and the movable handle 128. The kit would be used to retrofit an existing Irwin item no. 502L3 vise grips into the locking pliers 2.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

We claim:

1. A one hand operated locking pliers comprising:

a fixed handle having an adjustment device disposed on one end;

a fixed jaw is rigidly retained in an opposing end of the fixed handle;

a movable jaw is pivotally retained in substantially the opposing end of the fixed handle;

a power triangle link having a first corner, a second corner and a third corner;

a movable handle having one end pivotally retained by said first corner of said power triangle link;

a toggle link having one end engaged with said adjustment device, said second corner is pivotally engaged with an opposing end of said toggle link, said third corner of said power triangle is pivotally engaged with the movable jaw; and at least one tie link having one end pivotally connected to said toggle link and an opposing end pivotally connected to said movable handle.

2. The One hand operated locking pliers of claim 1, further comprising:

a biasing spring having one end secured to the movable jaw and an opposing end secured to the fixed handle.

3. The one hand operated locking pliers of claim 1 wherein:

said adjustment device comprises an adjustment screw.

4. The one hand operated locking pliers of claim 1 wherein:

said opposing end of said at least one tie link is slidably engaged with said movable handle.

5. The one hand operated locking pliers of claim 1 wherein:

a cam surface is formed on said one end of said movable handle, a contact surface is formed on said opposing end of said toggle link, wherein said cam surface contacts said contact surface when said one hand operated locking pliers is closed.

6. The one hand operated locking pliers of claim 1 wherein:

a stop surface is formed on said opposing end of said toggle link, wherein said stop surface engages said power triangle link when said one hand operated locking pliers is closed.

7. The one hand operated locking pliers of claim 1 wherein:

said power triangular link includes a first triangle plate, a second triangle plate and a connection plate, said first triangle plate extends from one end of said connection plate and said second triangle plate extends from the other end of said connection plate.

8. The one hand operated locking pliers of claim 1 wherein:

a cam surface is formed on said one end of said movable handle, a contact surface is formed on said opposing end of said toggle link, wherein said cam surface contacts said contact surface when said one hand operated locking pliers is closed.

9. The one hand operated locking pliers of claim 1 wherein:

a pin cavity is formed in said opposing end of said toggle link, said pin cavity contacts a power pin retained in said two power links when said one handed operated locking pliers is closed.

10. The one hand operated locking pliers of claim 1 wherein:

said release link includes a first plate, a second plate and a connection member, said first plate extends from a first end of said connection member and said second plate extends from a second end of said connection member, a retention projection extends from said first end of said of said second plate.

11. A kit for retrofiting an existing locking pliers comprising:

a power triangle link having a first corner, a second corner and a third corner;

a movable handle having one end pivotally retained by said first corner of said power triangle link;

a toggle link having one end engaged with an adjustment device of the locking pliers, said second corner is pivotally engaged with an opposing end of said toggle link, said third corner of said power triangle is pivotally engaged with a movable jaw of the locking pliers; and at least one tie link having one end pivotally connected to said toggle link and an opposing end pivotally connected to said movable handle.

12. The one hand operated locking pliers of claim 11 wherein:

said opposing end of said at least one tie link is slidably engaged with said movable handle.

13. The one hand operated locking pliers of claim 11 wherein:

a cam surface is formed on said one end of said movable handle, a contact surface is formed on said opposing end of said toggle link, wherein said cam surface contacts said contact surface when said one hand operated locking pliers is closed.

14. The one hand operated locking pliers of claim 11 wherein:

a stop surface is formed on said opposing end of said toggle link, wherein said stop surface engages said power triangle link when said one hand operated locking pliers is closed.

15. The one hand operated locking pliers of claim 11 wherein:

said power triangle link includes a first triangle plate, a second triangle plate and a connection plate, said first triangle plate extends from one end of said connection plate and said second triangle plate extends from the other end of said connection plate.

16. A one hand operated locking pliers comprising:

a fixed handle having an adjustment device disposed on one end;

a fixed jaw is rigidly retained in an opposing end of the fixed handle;

a movable jaw is pivotally retained in substantially the opposing end of the fixed handle;

two power links, each one of said two power links includes a first end and a second end;

a movable handle having one end pivotally retained by said first end of said two power links;

a toggle link having one end engaged with said adjustment device, an opposing end of said toggle link is pivotally engaged with said two power links between said first and second ends thereof, said second end of said two power links is pivotally engaged with the movable jaw;

a release link having a first end and a second, said first end of said release link is pivotally engaged with said two power links, said second end is pivotally engaged with said toggle link; and at least one tie link having one end pivotally engaged with said toggle link and an opposing end pivotally engaged with said movable handle.

17. The one hand operated locking pliers of claim 16, further comprising:

a biasing spring having one end secured to the movable jaw and an opposing end secured to the fixed handle.

18. The one hand operated locking pliers of claim 16 wherein:

said adjustment device comprises an adjustment screw.

19. The one hand operated locking pliers of claim 16 wherein:

said opposing end of said at least one tie link is slidably engaged with said movable handle.

* * * * *